US010150133B2

(12) United States Patent
Johnson

(10) Patent No.: US 10,150,133 B2
(45) Date of Patent: Dec. 11, 2018

(54) BORE MASKING SYSTEM

(71) Applicant: Irenic Solutions, LLC, Bismarck, ND (US)

(72) Inventor: Corey A. Johnson, Bismarck, ND (US)

(73) Assignee: Irenic Solutions, LLC, Bismarck, ND (US)

( * ) Notice: Subject to any disclaimer, the term of this patent is extended or adjusted under 35 U.S.C. 154(b) by 314 days.

(21) Appl. No.: 14/178,850

(22) Filed: Feb. 12, 2014

(65) Prior Publication Data

US 2015/0224535 A1 Aug. 13, 2015

(51) Int. Cl.

| | |
|---|---|
| ***B05D 1/32*** | (2006.01) |
| ***B05B 12/26*** | (2018.01) |
| ***B05B 12/24*** | (2018.01) |
| *B05B 12/20* | (2018.01) |

(52) U.S. Cl.

CPC ..... *B05B 12/26* (2018.02); *B05B 12/24* (2018.02); *B05B 12/29* (2018.02)

(58) Field of Classification Search

CPC ..... B05D 1/32

See application file for complete search history.

(56) References Cited

U.S. PATENT DOCUMENTS

| | | | | |
|---|---|---|---|---|
| 4,871,585 | A * | 10/1989 | Kano et al. | 427/98.5 |
| 2002/0098293 | A1* | 7/2002 | Kokoschke et al. | 427/428 |
| 2007/0034219 | A1* | 2/2007 | Affinito | 131/329 |
| 2007/0137818 | A1* | 6/2007 | Levit et al. | 162/146 |

FOREIGN PATENT DOCUMENTS

| | | |
|---|---|---|
| EP | 1722932 | 5/2007 |

OTHER PUBLICATIONS

Kanda et al "Interface Property and Apparent Strength of High-Strength Hydrophillic Fiber in Cement Matrix" Journal of Materials in Civil Engineering, Feb. 1998, p. 5-13.* http://www.sealinfo.com/index.cfm?objectid=5FDF21BA-E081-2968-24D48A7194805C01; VB-72 Specification Data Sheet from InterFace Solutions; Received on Mar. 22, 2011.

http://www.capsnplugs.com/products/coatingplatingweldsplattermasking/; Paint Masking Products from Caps'n. Plugs; Received on Feb. 9, 2014.

http://www.caplugs.com/productdetails.aspx?id=1000061&itemno=PP-SH+Series; E.P.D.M. Pull Plugs from Caplugs; Received on Feb. 9, 2014.

* cited by examiner

*Primary Examiner* — Nathan H Empie

(74) *Attorney, Agent, or Firm* — Neustel Law Offices

(57) ABSTRACT

A bore masking system for effectively protecting the interior surface of a bore during all phases of the painting process. The bore masking system includes a tubular shield formed from a hydrophobic sheet to protect the interior surface of the bore during the various phases of the painting process including cleaning, painting and curing. The hydrophobic sheet repels liquids such as water, chemicals and paint to ensure the structural integrity of the tubular shield during the painting phases.

19 Claims, 17 Drawing Sheets

BORE MASKING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to bore masking devices and more specifically it relates to a bore masking system for effectively protecting the interior surface of a bore during all phases of the painting process.

Description of the Related Art

Any discussion of the related art throughout the specification should in no way be considered as an admission that such related art is widely known or forms part of common general knowledge in the field.

Painting of objects with bores is done every day. The bore may be comprised of a circular cross sectional area having a first open end and a second open end. It can be appreciated that the bore may have only one open end with a second closed end. The bore may have a smooth interior surface or a non-smooth interior surface (e.g. a plurality of splines or grooves). The bore may also include a keyway and/or rounded surface openings.

Examples of objects that are painted having at least one bore includes parts for tractors, tractor loader hinges, frame parts, support arms, hinges, joints, pulleys, sprockets, and other structures where a pin (or other elongated object) is later inserted through the bore after painting the object. While the objects typically painted are constructed of metal, the objects may be constructed of non-metal materials. It is important that the interior surface of the bore is not damaged or contaminated before, during or after the painting process. Painting of objects typically has three phases: (1) cleaning the object of undesirable substances, (2) applying paint to the object and (3) curing the paint.

Cleaning of the object includes but is not limited to abrasive blasting (e.g. sandblasting, bead blasting, shot blasting, sodablasting, wet abrasive blasting), spray washing, dip washing or otherwise applying a chemical cleaner to the object. Painting of the object may be accomplished using various types of painting processes including but not limited to liquid painting (e.g. spray painting), powder coating, e-coating (electrophoretic deposition), electroplating, plating and anodizing. Curing of the paint includes but is not limited to heating in a bake oven, fans or ambient air drying.

It is important to protect the bore of the object during the cleaning process from being directly contacted with the cleaning material, particularly when abrasive blasting processes such as sandblasting are used, to prevent the interior surface of the bore from being physically damaged. It is further important to protect the bore of the object during the actual painting portion of the painting process to prevent paint from being applied to the interior surface of the bore. While paint may be applied by spraying a liquid paint with spray nozzles, paint may also be applied by dipping the object within a dip tank containing the paint. Finally, it is important to protect the bore of the object during the curing of the paint so that paint applied to the exterior of the object does not accidentally drip into the bore prior to hardening.

To protect the bore of the object during the painting process, users must mask the bore with a masking product to prevent damage to the interior surface of the bore. Conventional masking products used to mask a bore include silicone plugs (tapered and non-tapered), silicone flange caps, EDPM pull plugs, masking tape, flexible silicone foam cord and silicone tubing. One of the problems with conventional masking products is that they typically are sized to fit within a specific diameter and/or length of bore thereby requiring a painter to purchase various sizes of the masking products for different diameters and/or lengths of bores. Tapered silicone plugs do exist however they are limited to a range of diameters and can leave the distal end of the bore exposed if not properly used. Another problem with conventional masking products is they are not suitable for allowing a hook or other support member to extend through the bore to support the object during the cleaning, painting and/or curing processes. A further problem with conventional masking products is that they may potentially maintain a conductivity between the hook and the part to be painted. Another problem with silicone plugs is that they can be difficult to remove from the bore after the paint is cured. Another problem due to the high cost of silicone, returnable systems must be put into place and managed which can include cleaning of the plug as paint sticks to them and flakes off causing defects if used again and not cleaned which also creates a mess of paint flakes for the user during handling.

One type of masking product recently used is compressed cardboard rolled up to be inserted into the bore. Recently, flat and planar resilient sheets of non-metal gasket material have been used as a masking product to provide a solution to the inherent problems with conventional masking products. In particular, the gasket material is received by the painter in sheet form (e.g. 5×7 inches) and the painter manually rolls the sheet of gasket material into a tubular sleeve that is then inserted into the bore and then allowed to expand to the size of the bore to protect the interior surface of the bore. Another example of a gasket material that has been used as a masking product for the past couple of years is VB-72 PRO-FORMANCE®/MICROPORE® manufactured by Interface Solutions, Inc. in Lancaster, Pa. While the sheets of gasket material rolled into a tubular sleeve solve the problems experienced by the older masking products discussed above, a new problem was encountered wherein the gasket material absorbs liquids during the cleaning process. After the gasket material absorbs the liquid, the gasket material loses some of the resiliency needed to remain snugly within the bore. Once the gasket material has absorbed a portion of liquid and loses its resiliency, the gasket material may sag exposing portions of the bore or may completely fall out of the bore. In addition, the gasket material also absorbed paint creating similar problems and also creating the problem of when the paint is cured with baking that the paint absorbed by the gasket material is cured to the interior surface of the bore making a clean removal of the gasket material difficult.

Because of the inherent problems with the related art, there is a need for a new and improved bore masking system for effectively protecting the interior surface of a bore during all phases of the painting process.

BRIEF SUMMARY OF THE INVENTION

The invention generally relates to a bore masking system which includes a tubular shield formed from a hydrophobic sheet to protect the interior surface of the bore during the various phases of the painting process including cleaning, painting and curing. The hydrophobic sheet repels liquids such as water, chemicals and paint to ensure the structural integrity of the tubular shield during the painting phases.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1A:
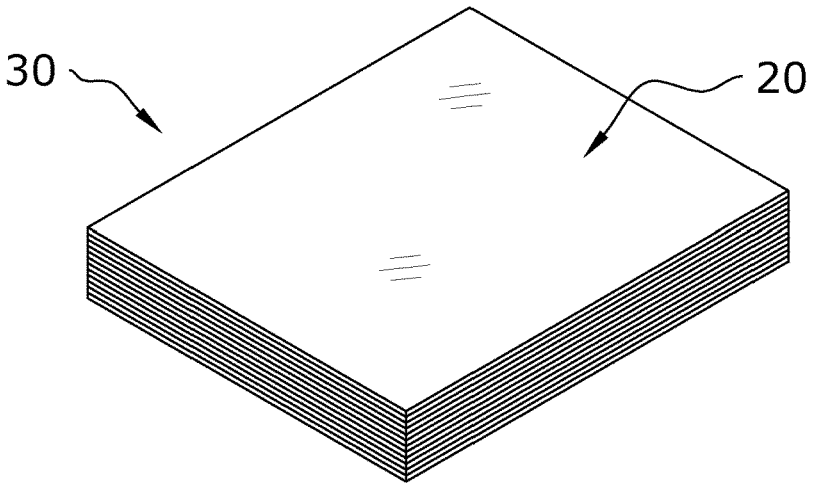
FIG. 1*a* is an upper perspective view of a stack of sheets comprised of a plurality of hydrophobic sheets.
Figure 1B:
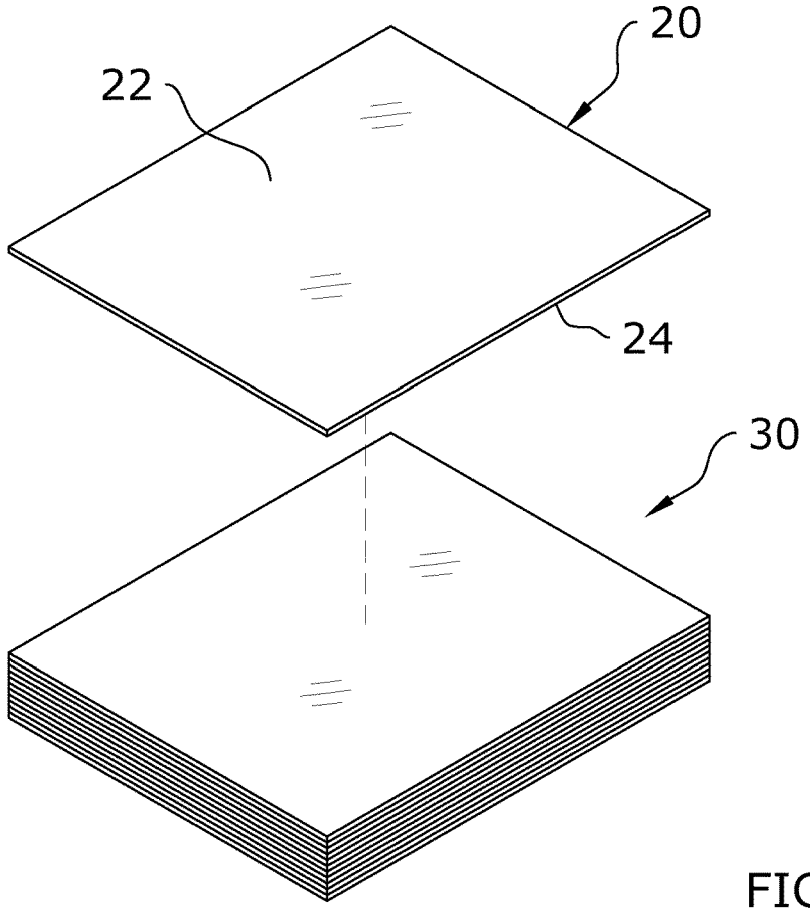
FIG. 1*b* is an upper perspective view of a hydrophobic sheet removed from the stack of sheets.
Figure 2:
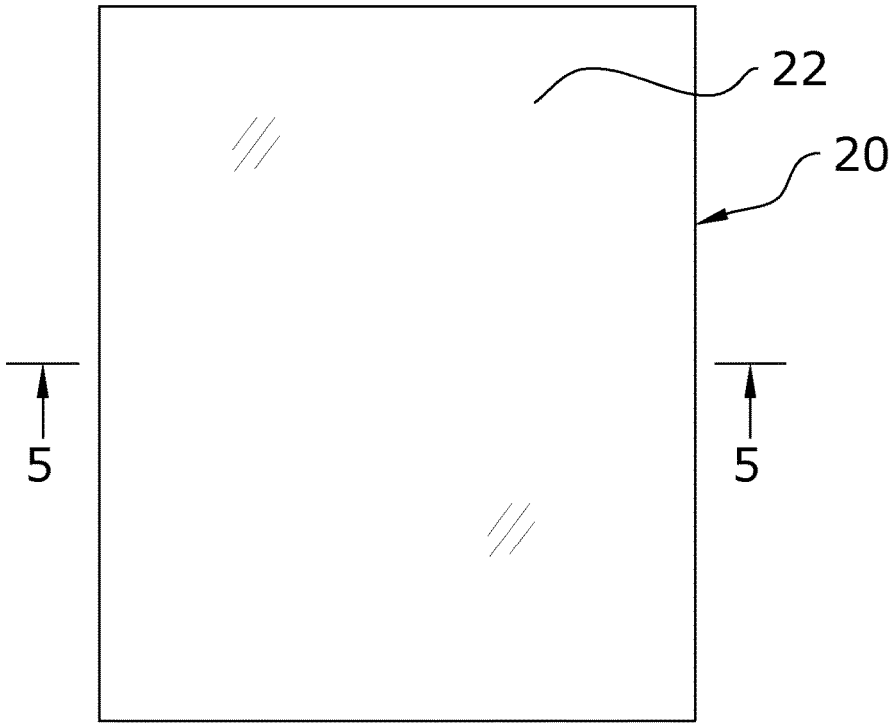
FIG. 2 is a top view of the hydrophobic sheet in the initial planar state.
Figure 3A:
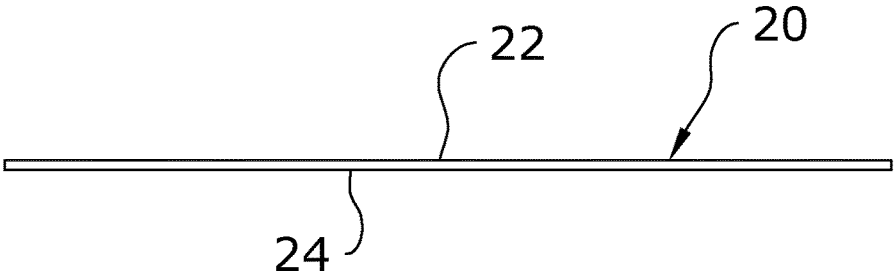
FIG. 3*a* is a side view of the hydrophobic sheet in the initial planar state.
Figure 3B:
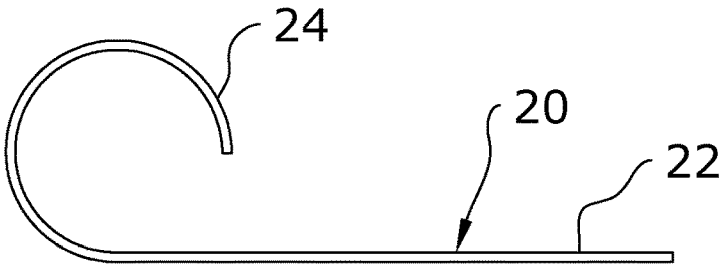
FIG. 3*b* is a side view of the hydrophobic sheet starting to be rolled upon itself.
Figure 3C:
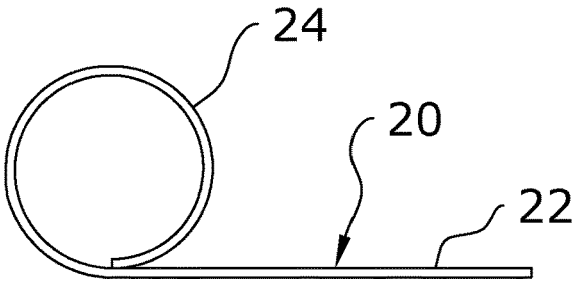
FIG. 3*c* is a side view of the hydrophobic sheet partially rolled upon itself.
Figure 3D:
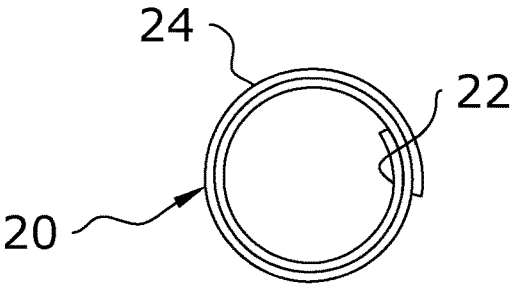
FIG. 3*d* is a side view of the hydrophobic sheet rolled into a tubular shield.

Turning now descriptively to the drawings, in which similar reference characters denote similar elements throughout the several views, FIGS. 1 through 9 illustrate a bore 12 masking system, which comprises a hydrophobic tubular shield formed from a hydrophobic sheet 20 to protect the interior surface of the bore 12 during the various phases of the painting process including cleaning, painting and curing. The hydrophobic sheet 20 repels liquids such as water, chemicals and paint to ensure the structural integrity of the tubular shield during the painting phases.

As illustrated in FIGS. 3*d*, 4*d* through 4*k*, the present invention is comprised of a hydrophobic tubular shield that is compressed to a smaller exterior diameter than the interior diameter of the bore 12 thereby allowing the hydrophobic tubular shield to expand and directly contact the interior surface of the bore 12 along the entire length of the bore 12. The hydrophobic tubular shield is formed from a hydrophobic sheet 20 having a first surface 22 and a second surface 24 opposite of the first surface 22 as illustrated in FIGS. 1*a* through 3*a* of the drawings. In one embodiment of the present invention, the end user (e.g. a painter) forms the hydrophobic sheet 20 removed from a stack of sheets 30 (or cut from a bulk roll of material) into the hydrophobic tubular shield. In another embodiment of the present invention, the hydrophobic sheet 20 is formed into the hydrophobic tubular shield at a manufacturing facility and then shipped to the end user in a tubular structure.

B. Hydrophobic Sheet

Hydrophobic sheet is comprised of a hydrophobic resilient material sufficient in resiliency to expand the hydrophobic tubular shield against the interior surface of the bore 12 to prevent accidental removal of the hydrophobic tubular shield during cleaning, painting and curing processes performed on the object 10. The hydrophobic sheet 20 is further comprised of a material that is resistant to heat up to temperatures of 400 degrees Fahrenheit or more which are encountered in a bake oven used for curing paint after painting the object 10. The hydrophobic sheet 20 preferably has a tensile strength of at least 1,500 PSI and further preferably has a tensile strength of at least 3,500 PSI. The hydrophobic sheet 20 further preferably has a minimum recovery percentage of at least 50%. The hydrophobic sheet 20 further preferably has a compressibility of only 3-10% at 1,000 PSI. The hydrophobic sheet 20 is further preferably comprised of a material that provides chemical stability along with resistance to water, oils, liquid chemicals, paint, steam and gases.

The hydrophobic sheet 20 has an initial state which may be planar shape, curved shape or pre-formed into a tubular or semi-tubular shape. The hydrophobic sheets 20 may be formed into a stack of sheets 30 which may or may not be separated by a separating sheet of material to prevent sticking of the hydrophobic sheets 20 together (alternatively, a nonstick coating on one side of the hydrophobic sheet 20 may be applied to prevent sticking of the sheets 20 such as polytetrafluoroethylene sold as TEFLON® by DuPont).

Figure 8A:
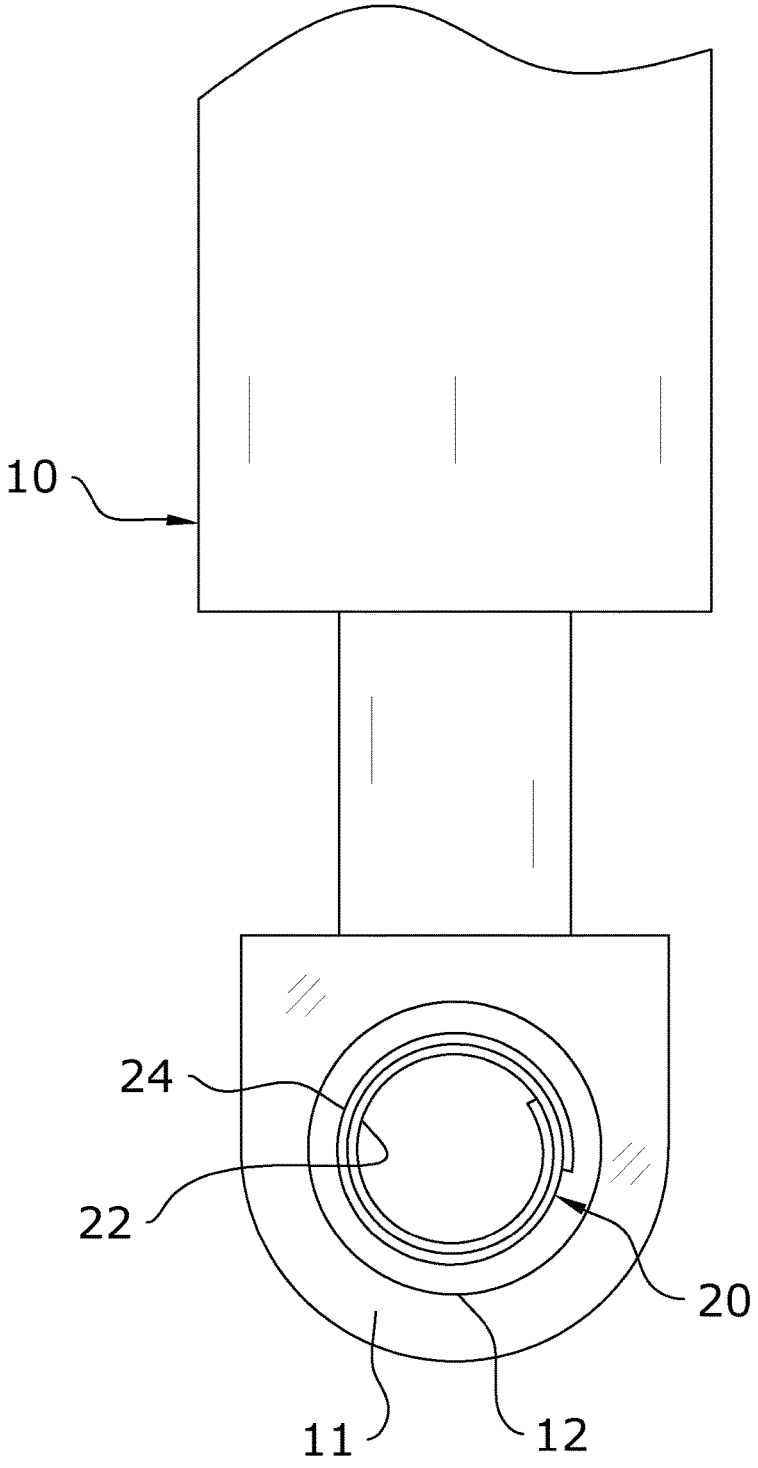
FIG. 8*a* is a side view of the tubular shield positioned within the bore in a contracted state.
Figure 8B:
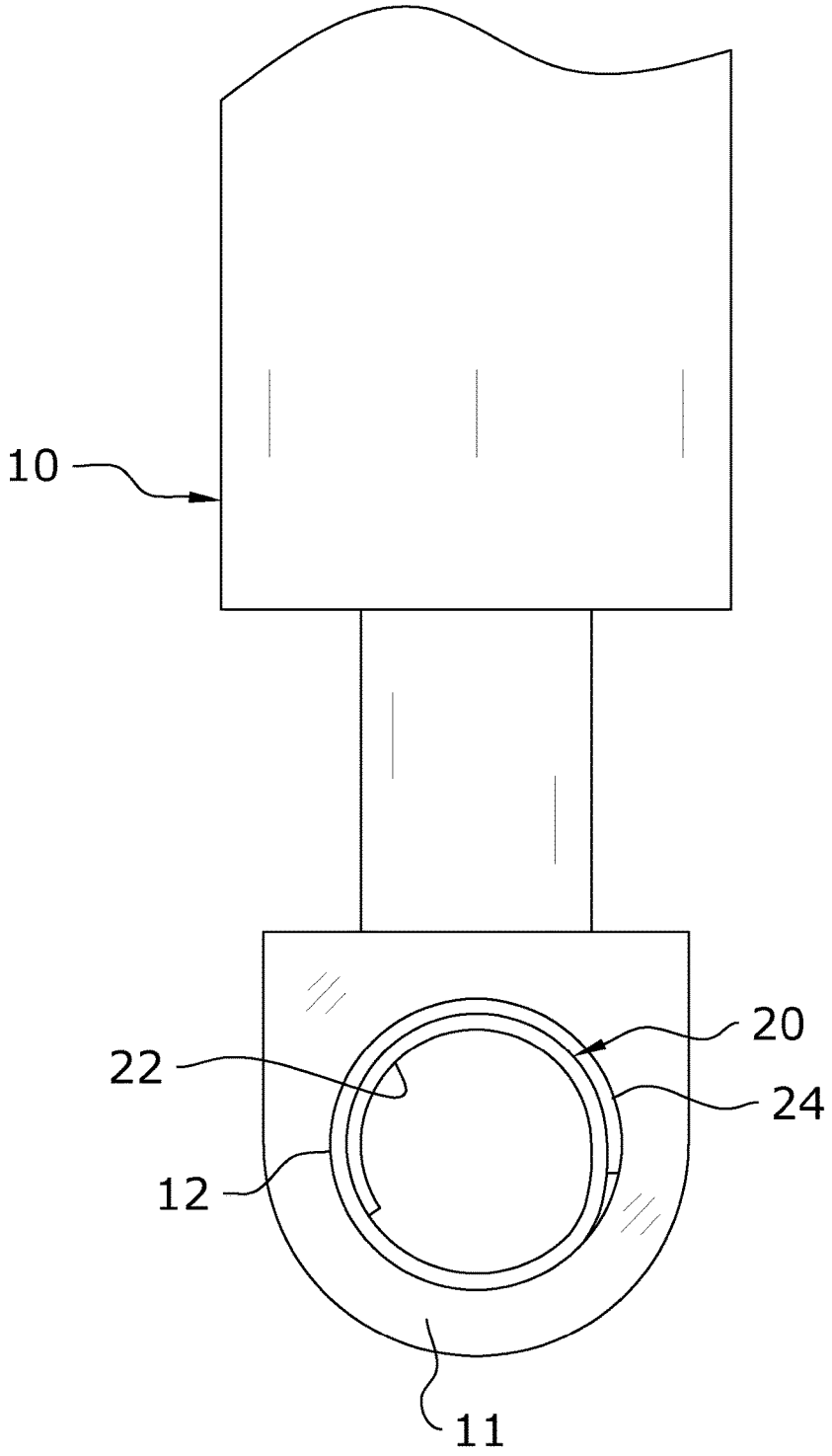
FIG. 8*b* is a side view of the tubular shield positioned within the bore in an expanded state.
Figure 8C:
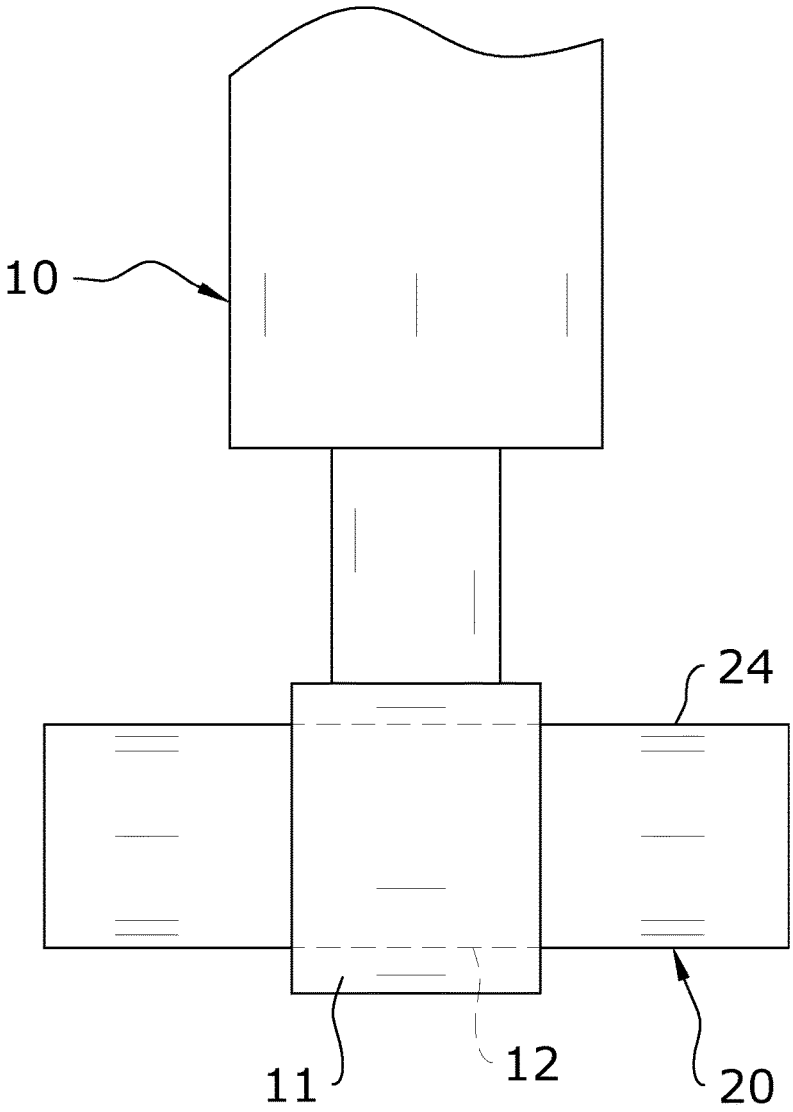
FIG. 8*c* is a front view of the tubular shield positioned within the bore of the object.
Figure 9:
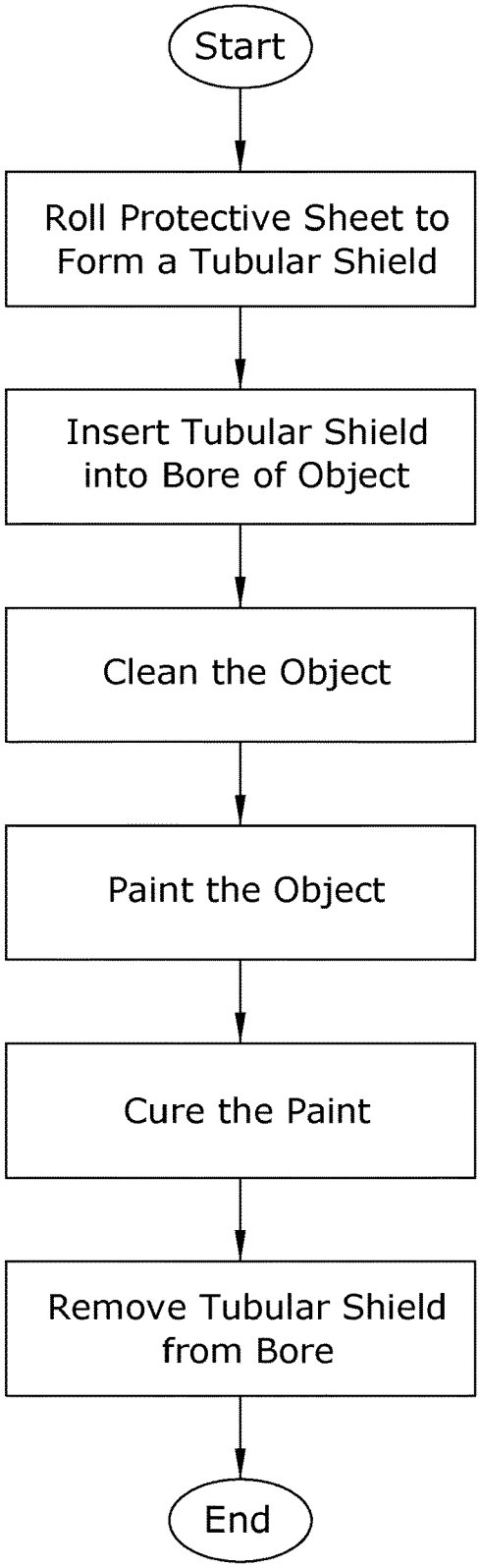
FIG. 9 is a flowchart illustrating the overall process and method of use for the present invention.

The hydrophobic sheet 20 is preferably comprised of either a square or rectangular shape when in the initial state thereby allowing the formation of a tubular structure having consistent and parallel ends as illustrated in FIG. 8*c* of the drawings. The hydrophobic sheet 20 may have various dimensions and thicknesses depending upon the diameter of the bore 12.

Figure 4A:
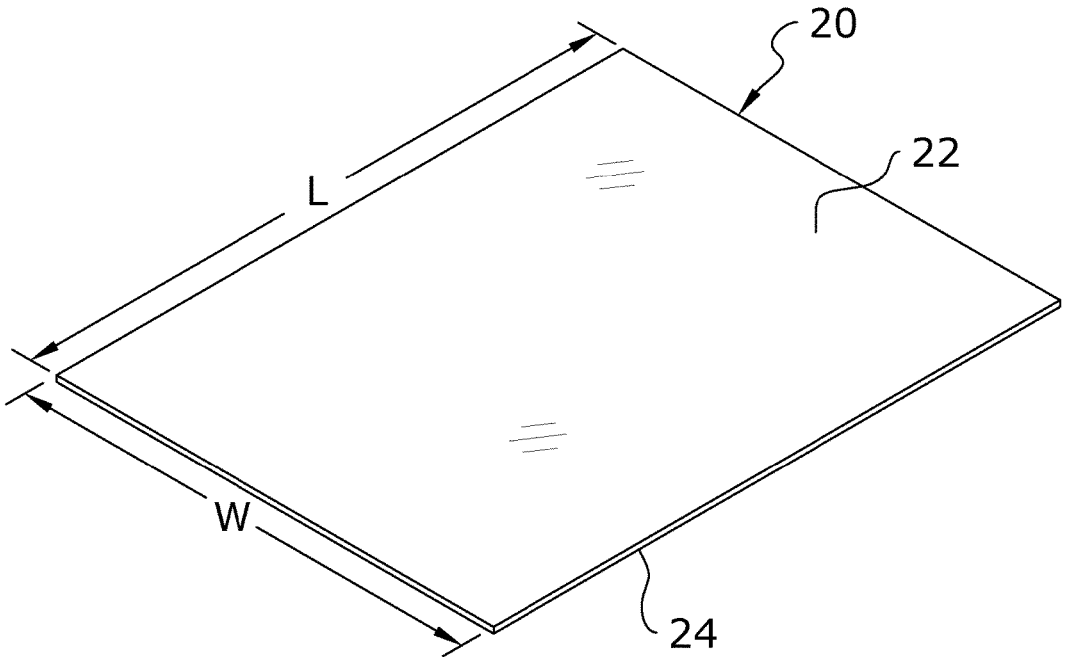
FIG. 4*a* is an upper perspective view of the hydrophobic sheet in the initial planar state.
Figure 4B:
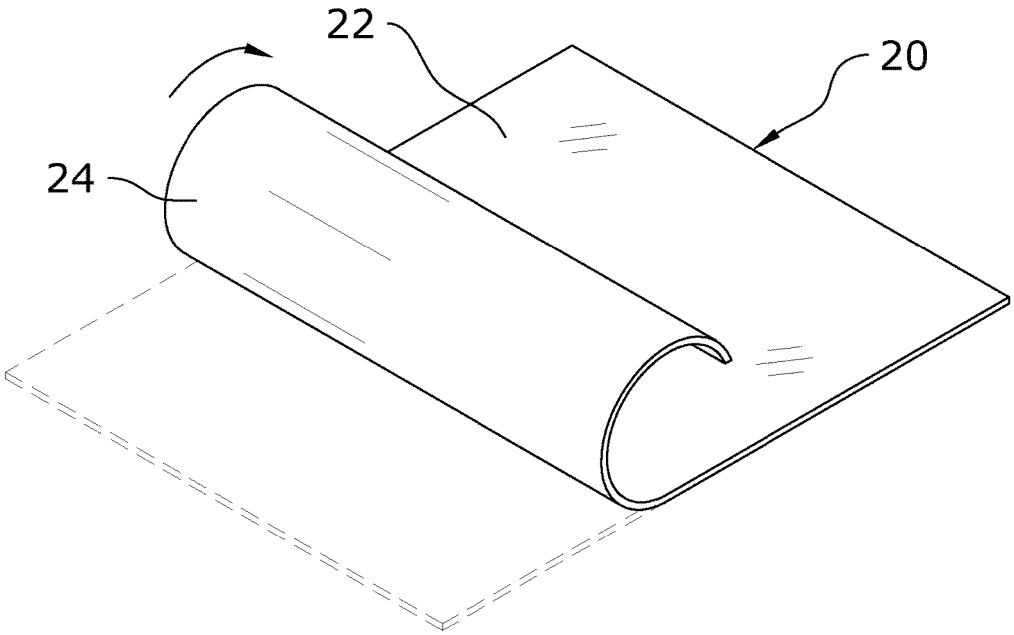
FIG. 4*b* is an upper perspective view of the hydrophobic sheet starting to be rolled upon itself.
Figure 4C:
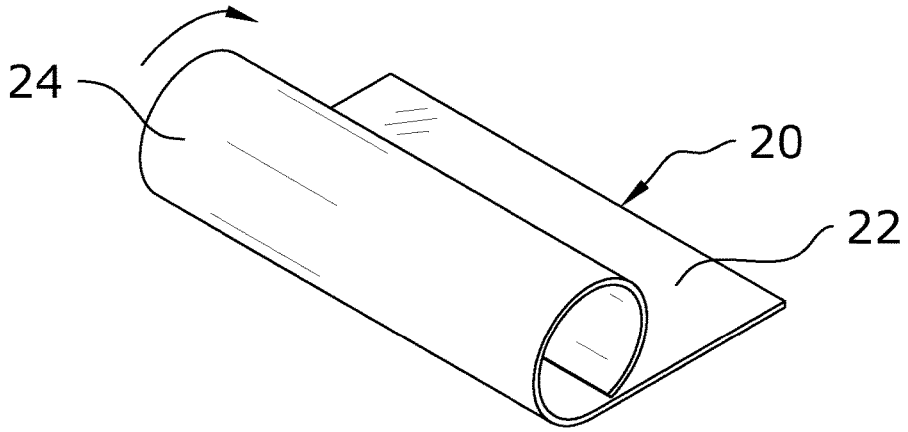
FIG. 4*c* is an upper perspective view of the hydrophobic sheet partially rolled upon itself.

The length L of the hydrophobic sheet 20 is measured transverse to a longitudinal axis of the hydrophobic tubular shield after forming of the tubular shield and the width W of the hydrophobic sheet 20 is measured parallel to the longitudinal axis of the hydrophobic tubular shield as illustrated in FIG. 4*a*.

Figure 6:
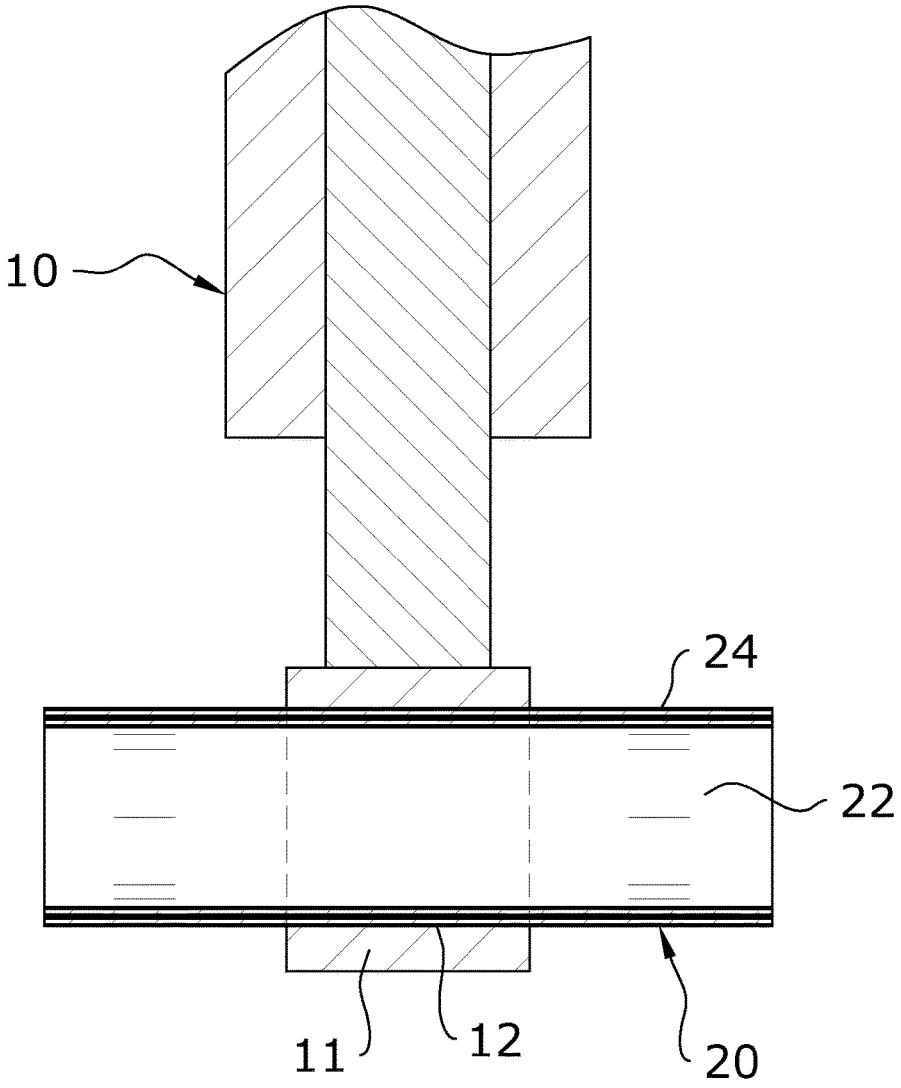
FIG. 6 is a cross sectional view taken along line 6-6 of FIG. 4*j*.

It is preferable that the hydrophobic sheet 20 have a width W sufficient to allow the hydrophobic tubular shield to extend outwardly from both open ends of the bore 12 by at least one to two inches or more (if the bore 12 has a closed end, then the width W is sufficient to extend outwardly from the open end of the bore 12 by at least one inch) as best illustrated in FIGS. 6 and 8*c* of the drawings. The extended end portions of the tubular shield ensure that the interior surface of the bore 12 is not contacted by cleaning materials (e.g. sand particles from sandblasting) or paint. For example, if the axial length of a bore 12 is four inches, then the width W of the hydrophobic sheet 20 is preferably at least six inches to allow for extension of at least one inch past both open ends of the bore 12.

It is further preferable that the hydrophobic sheet 20 have a length L sufficient to allow for at least 50% to 100+% wrapping of the hydrophobic sheet 20 as illustrated in FIGS. 4*d*, 7*a* through 8*b* of the drawings. It is further preferable that the length L of the hydrophobic sheet 20 be at least greater than or equal to the circumference of the bore 12 plus 50% of the circumference of the bore 12 to ensure that at least 50% wrapping of the hydrophobic sheet 20 is achieved. For example, if the circumference of a bore 12 is four inches, the length L of the hydrophobic sheet 20 is preferably at least six inches thereby providing for at least two inches of overlap of the hydrophobic sheet 20 when wrapped into a tubular roll shape.

Below are some additional examples of desired sizes for the hydrophobic sheet 20 based on the size of the bore 12.

| Bore Circumference | Bore Length | Minimum Width of Sheet | Minimum Length of Sheet |
|---|---|---|---|
| 4 Inches | 4 Inches | 6 Inches | 6 Inches |
| 6 Inches | 4 Inches | 6 Inches | 9 Inches |

-continued

| Bore Circumference | Bore Length | Minimum Width of Sheet | Minimum Length of Sheet |
|---|---|---|---|
| 8 Inches | 4 Inches | 6 Inches | 12 Inches |
| 10 Inches | 6 Inches | 8 Inches | 15 Inches |

It can be appreciated that various standard sizes for the hydrophobic sheet 20 may be used such as 5×7 inches, 7×10 inches, 5×10 inches, 10×15 inches and the like. In addition, the hydrophobic sheet 20 may be comprised of a large roll of hydrophobic material having a predetermined width (e.g. 5 inches) wherein the length L of the sheet is determined by the end user cutting the desired length with a scissors or other cutting device. Alternatively, perforations or weakened areas at equidistantly spaced locations along the length of the sheet of hydrophobic material may be used which allow the user to simply tear along to acquire the desired length of hydrophobic sheet 20.

The hydrophobic sheet 20 preferably has a thickness of between 0.012 inches to 0.032 inches, however, greater or less thicknesses may be used depending upon the diameter of bore 12 used upon. The greater the diameter size of the bore 12, the thicker the hydrophobic sheet 20 is comprised of to provide additional resiliency to the hydrophobic tubular shield formed from thereof. Below is a chart illustrating some thicknesses for the hydrophobic sheet 20 found to be suitable for different diameters of bores 12.

| Thickness of Hydrophobic Sheet | Bore Diameter (Minimum) | Bore Diameter (Maximum) |
|---|---|---|
| 0.012 Inches | 0.75 Inches | 2.50 Inches |
| 0.017 Inches | 2.00 Inches | 4.00 Inches |
| 0.022 Inches | 3.00 Inches | 6.00 Inches |
| 0.032 Inches | 4.00 Inches | 9.00+ Inches |

C. 1s Embodiment of Hydrophobic Sheet

In a first embodiment of the present invention, the hydrophobic sheet 20 (and the resulting hydrophobic tubular shield) is comprised of a composition of a base material and a binder material. The base material is preferably comprised of a hard (highly densified) fiber material. The base material is preferably comprised of a heat resistant material such as heat resistant fibers (e.g. compressed aramid fibers). It is important that the fibers are highly compressed to maintain a desired resiliency property. Alternative materials for the base material include but are not limited to polyester film (biaxially-orientated polyethylene terephthalate sold under the trademark MYLAR), plastic, polyester (PET), silicone base, polyimide, fiberglass, plastic laminate, acrylic sheeting, resin sheeting, thin metallic materials, thicker tin foil material type, high density fiber board or hardboard, compressed wood fiber, steam-cooked and pressure-molded wood fibers, paperboard and high temperature linoleum.

The binder material is preferably comprised of a rubber material. The binder material is further preferably comprised of a nitrile (e.g. nitrile rubber, nitrile butadiene rubber). The binder material repels water, liquid chemicals and paint to prevent the entry of the same into the base material thereby maintaining the resiliency of the hydrophobic sheet 20. Alternative materials for the binder material include but are not limited to acrylonitrile-butadiene, chloroprene, ethylene propylene, fluorosilicone, perfluoroelastomer, silicone, butyl, ethylene acrylic, fluorocarbon, hydrogenated nitrile, and polyacrylate.

The hydrophobic sheet 20 may be comprised of only one material of the base material compressed into a sheet of material. In addition, the hydrophobic sheet 20 may be comprised of any combination of one or more base materials with one or more binder materials discussed herein.

D. $2^{nd}$ Embodiment of Hydrophobic Sheet

In a second embodiment of the present invention, the hydrophobic sheet 20 (and the resulting hydrophobic tubular shield) is comprised of a core material 26 coated with a first hydrophobic layer 27 and a second hydrophobic layer 28 on opposing sides of the core material 26. The hydrophobic sheet 20 is comprised of a core material 26 coated with a first hydrophobic layer 27 to form the first surface 22 and a second hydrophobic layer 28 to form the second surface 24.

The core material 26 may be comprised of a hydrophobic material. However, the core material 26 may also be comprised of a non-hydrophobic material with the hydrophobic layers 27, 28 surrounding and protecting the non-hydrophobic material. The core material 26 is preferably comprised of a hard (highly densified) fiber material. The core material 26 is preferably comprised of a heat resistant material such as heat resistant fibers (e.g. compressed aramid fibers). As with the first embodiment, it is important that the fibers are highly compressed to maintain a desired resiliency property. Alternative materials for the core material 26 include but are not limited to polyester film (biaxially-orientated polyethylene terephthalate sold under the trademark MYLAR), plastic, polyester (PET), silicone base, polyimide, fiberglass, plastic laminate, acrylic sheeting, resin sheeting, thin metallic materials, thicker tin foil material type, high density fiber board or hardboard, compressed wood fiber, steam-cooked and pressure-molded wood fibers, paperboard and high temperature linoleum.

The hydrophobic layers 27, 28 are preferably comprised of a rubber (e.g. silicone rubber). The hydrophobic layers 27, 28 are further preferably comprised of a nitrile (e.g. nitrile rubber, nitrile butadiene rubber). The hydrophobic layers 27, 28 may also be comprised of various other hydrophobic materials such as but not limited to plastic, silicone and the like. The hydrophobic layers 27, 28 repel water, liquid chemicals and paint to prevent the entry of the same into the core material 26 thereby maintaining the resiliency of the hydrophobic sheet 20. Alternative materials for the hydrophobic layers 27, 28 include but are not limited to acrylonitrile-butadiene, chloroprene, ethylene propylene, fluorosilicone, perfluoroelastomer, silicone, butyl, ethylene acrylic, fluorocarbon, hydrogenated nitrile, and polyacrylate.

E. Forming of the Hydrophobic Sheet into a Hydrophobic Tubular Shield

To form the hydrophobic tubular shield, the hydrophobic sheet 20 is first rolled upon itself into a tubular structure having opposing open ends as illustrated in FIGS. 4*a* through 4*d* of the drawings. The forming of the hydrophobic sheet 20 into hydrophobic tubular shield may be performed manually by a person or by a machine. The end product comprised of the hydrophobic tubular shield may be used immediately after forming or packaged after forming for use at a later time (or for shipping to a different end user).

Figure 4D:
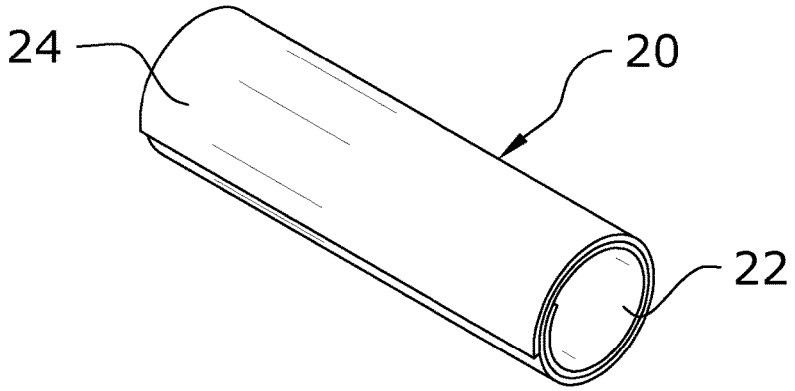
FIG. 4*d* is an upper perspective view of the hydrophobic sheet rolled into a tubular shield.
Figure 7A:
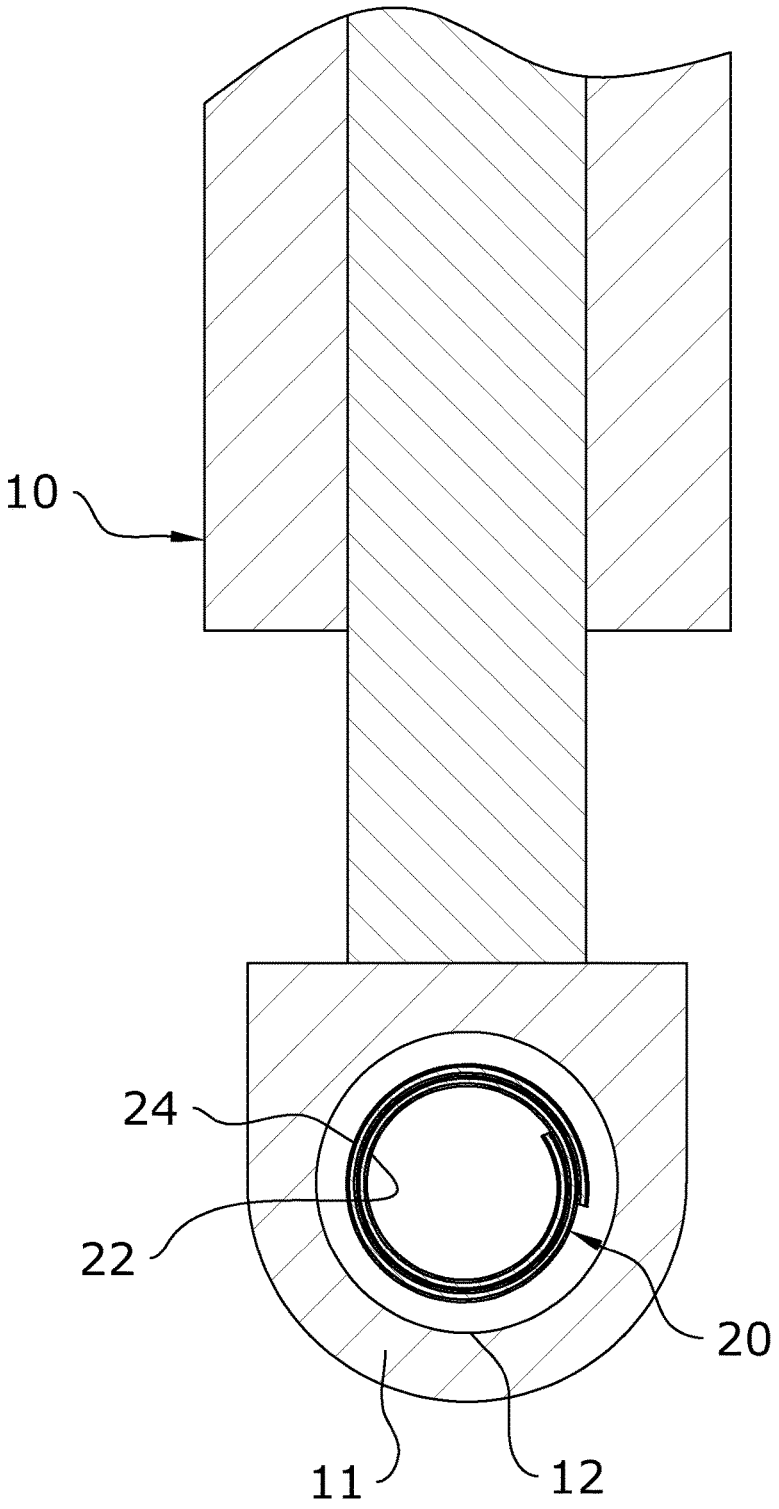
FIG. 7*a* is a cross sectional view taken along line 7*a*-7*a* of FIG. 4*g*.

To roll the hydrophobic sheet 20, the user (or manufacturer) starts at a first end of the hydrophobic sheet 20 (see FIG. 4*b*) and then continues to roll the first end along the length L of the hydrophobic sheet 20 until the second end of the hydrophobic sheet 20 is rolled into the tubular shape (see FIG. 4*d*). The initial exterior diameter of the hydrophobic tubular shield formed by the rolling of the hydrophobic sheet 20 is less than the interior diameter of the bore 12 when in the intermediate state as best illustrated in FIGS. 7*a* and 8*a* of the drawings. The hydrophobic sheet 20 is wrapped at least 150% to form the hydrophobic tubular shield as best illustrated in FIGS. 7*a* and 8*a* of the drawings.

F. Insertion of Hydrophobic Tubular Shield into Bore

Figure 4E:
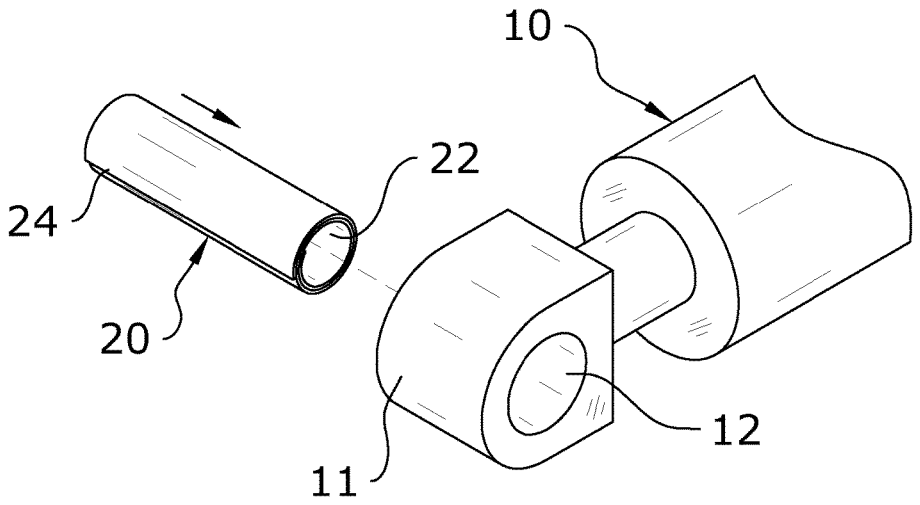
FIG. 4*e* is an upper perspective view of the tubular shield prior to insertion into a bore of an object.
Figure 4F:
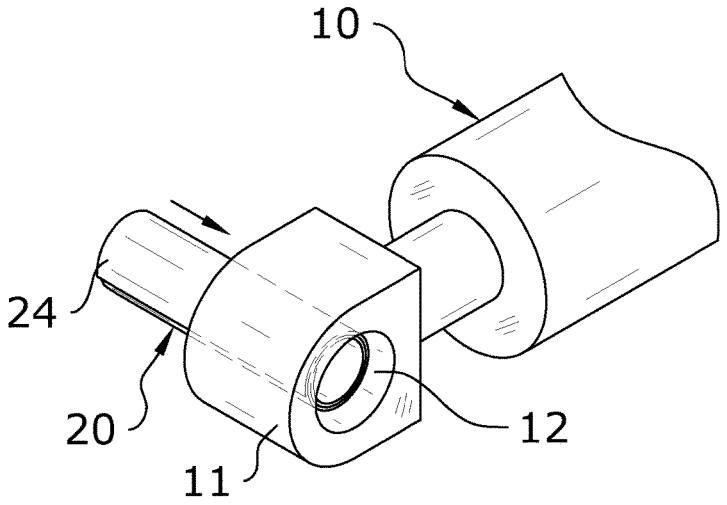
FIG. 4*f* is an upper perspective view of the tubular shield partially inserted into the bore.
Figure 4G:
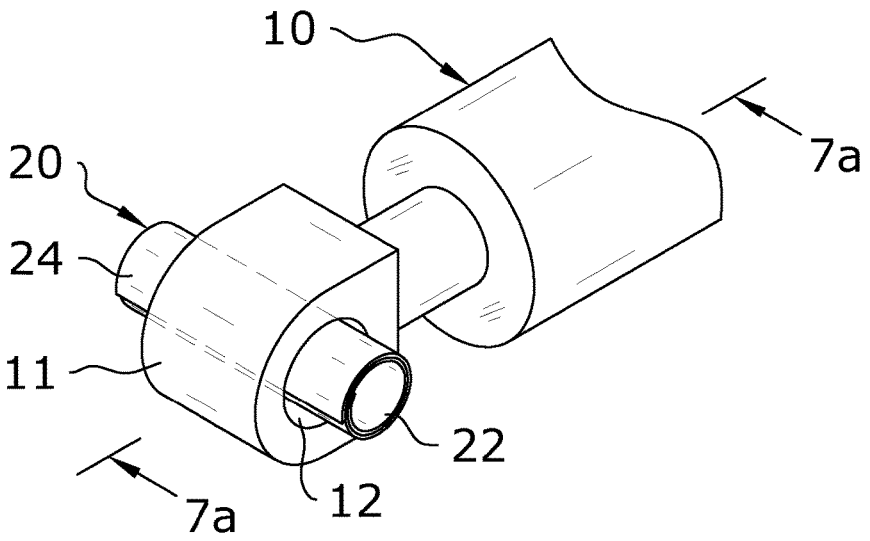
FIG. 4*g* is an upper perspective view of the tubular shield contracted and fully inserted into the bore with both ends of the tubular shield extending outwardly from the bore.
Figure 4H:
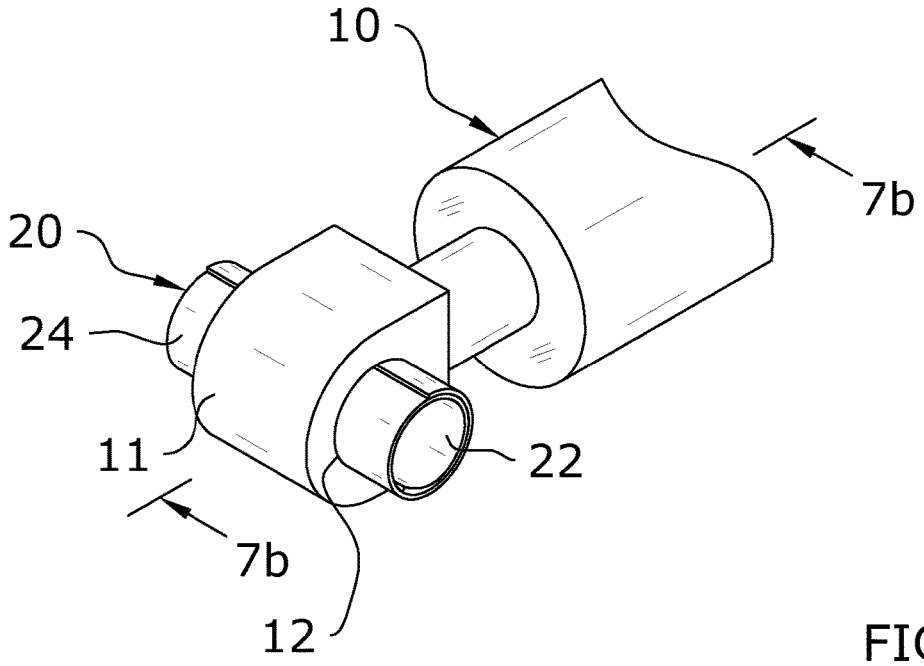
FIG. 4*h* is an upper perspective view of the tubular shield expanded within the bore to engage and contact the interior surface of the bore.

Prior to insertion of the rolled hydrophobic sheet 20 (i.e. the hydrophobic tubular shield) into the bore 12, the user retains the hydrophobic tubular shield in the intermediate state which is compressed prior to positioning in the bore 12. The user then aligns the longitudinal axis of the rolled hydrophobic sheet 20 with the axis of the bore 12 as illustrated in FIG. 4*e* and then inserts a first end of the rolled hydrophobic sheet 20 into the first open end of the bore 12 as illustrated in FIG. 4*f* of the drawings. The user continues the insertion of the rolled hydrophobic sheet 20 until at least one inch or more of the rolled hydrophobic sheet 20 extends outwardly from the first open end and the second open end of the bore 12 as illustrated in FIGS. 4*h*, 6 and 8*c* of the drawings.

Figure 7B:
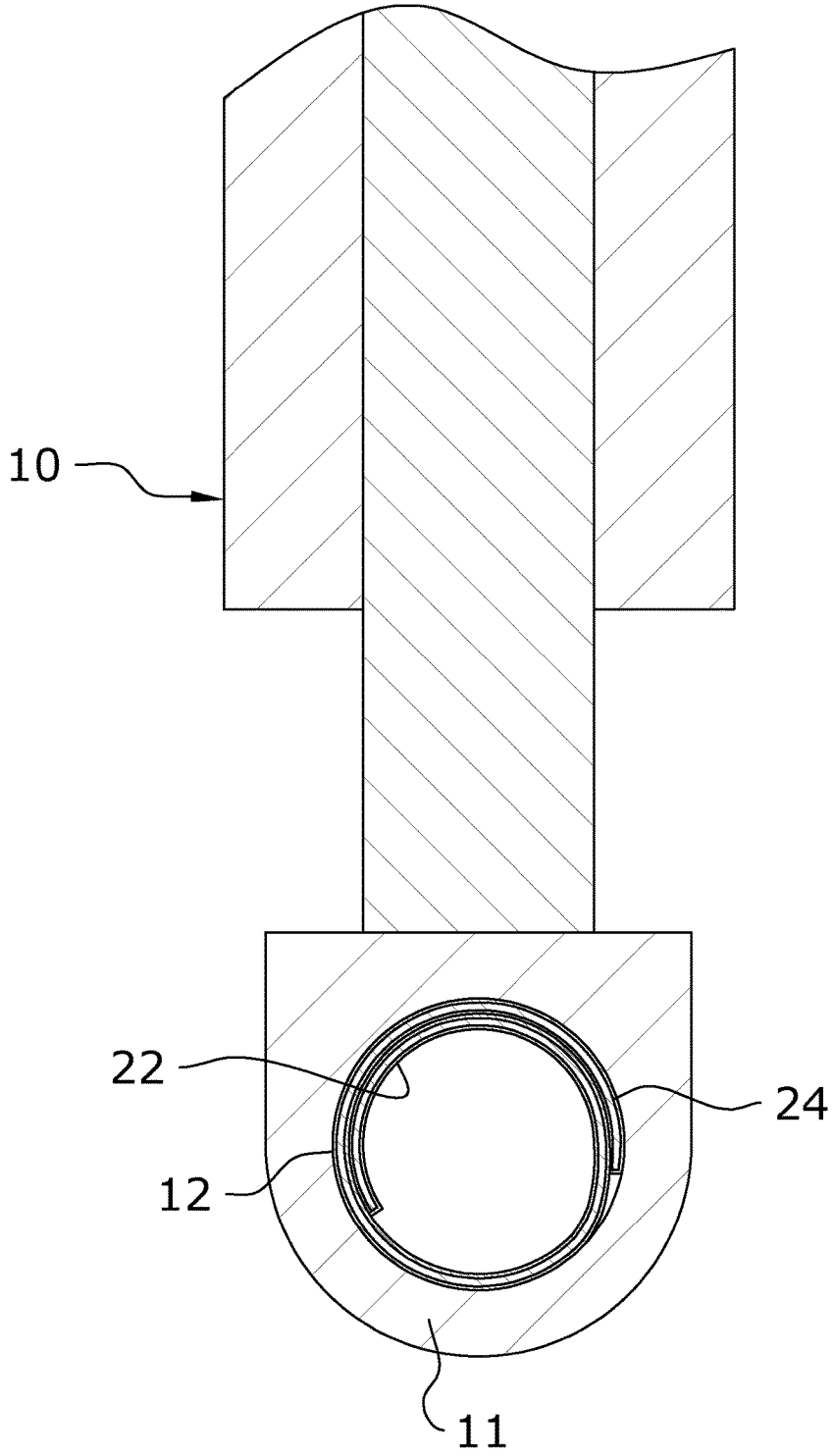
FIG. 7*b* is a cross sectional view taken along line 7*b*-7*b* of FIG. 4*h*.

Once the rolled hydrophobic sheet 20 is fully inserted, the user terminates the retaining of the hydrophobic tubular shield in the intermediate state (see FIGS. 7*a* and 8*a*) which allows for the expansion of the tubular shield against and in direct contact with the interior surface of the bore 12 because of the resiliency of the hydrophobic sheet 20 (see FIGS. 7*b* and 8*b*). As is shown in FIGS. 7*a* through 8*b*, the exterior diameter of the hydrophobic tubular shield is greater in the final expanded state than in the intermediate state. The direct contact with the interior surface of the bore 12 prevents particles (e.g. sand) and paint from contacting the interior surface of the bore 12. The entire interior surface of the bore 12 is preferably in contact with the second surface 24 (i.e. exterior surface) of the rolled hydrophobic sheet 20.

G. Cleaning and Painting of the Object

Figure 4I:
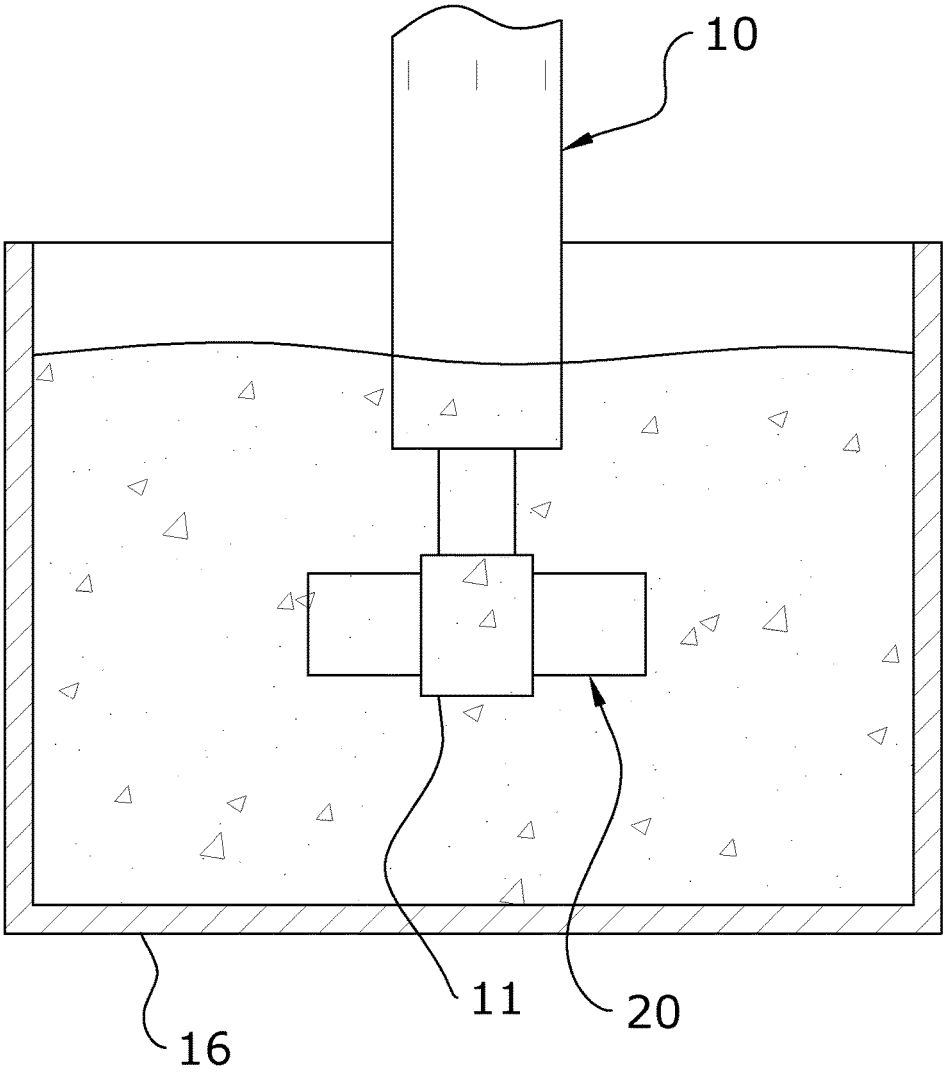
FIG. 4*i* is a side view of the object with the tubular shield within the bore inserted into a cleaning tank with a liquid cleaning solution.

With the rolled hydrophobic sheet 20 properly positioned within the bore 12, the object 10 and the segment 11 of the object 10 containing the bore 12 may then be cleaned by either dipping the object 10 along with the rolled hydrophobic sheet 20 into a cleaning tank 16 containing a volume of liquid cleaner for a period of time as illustrated in FIG. 4*i* of the drawings or by performing a spray wash, or a combination of the two washing systems. One advantage of the present invention is that a hook or smaller pin may be inserted through the interior of the rolled hydrophobic sheet 20 to provide support to the object 10 for lifting/lowering while maintaining protection for the entire interior surface of the bore 12. The hydrophobic properties of the rolled hydrophobic sheet 20 prevent the liquid cleaner/chemicals from being absorbed by the rolled hydrophobic sheet 20 and also assist in repelling the liquid cleaner/chemicals from the interior surface of the bore 12. Various other cleaning processes may be performed as can be appreciated by one skilled in the art of painting (e.g. sandblasting).

Figure 4J:
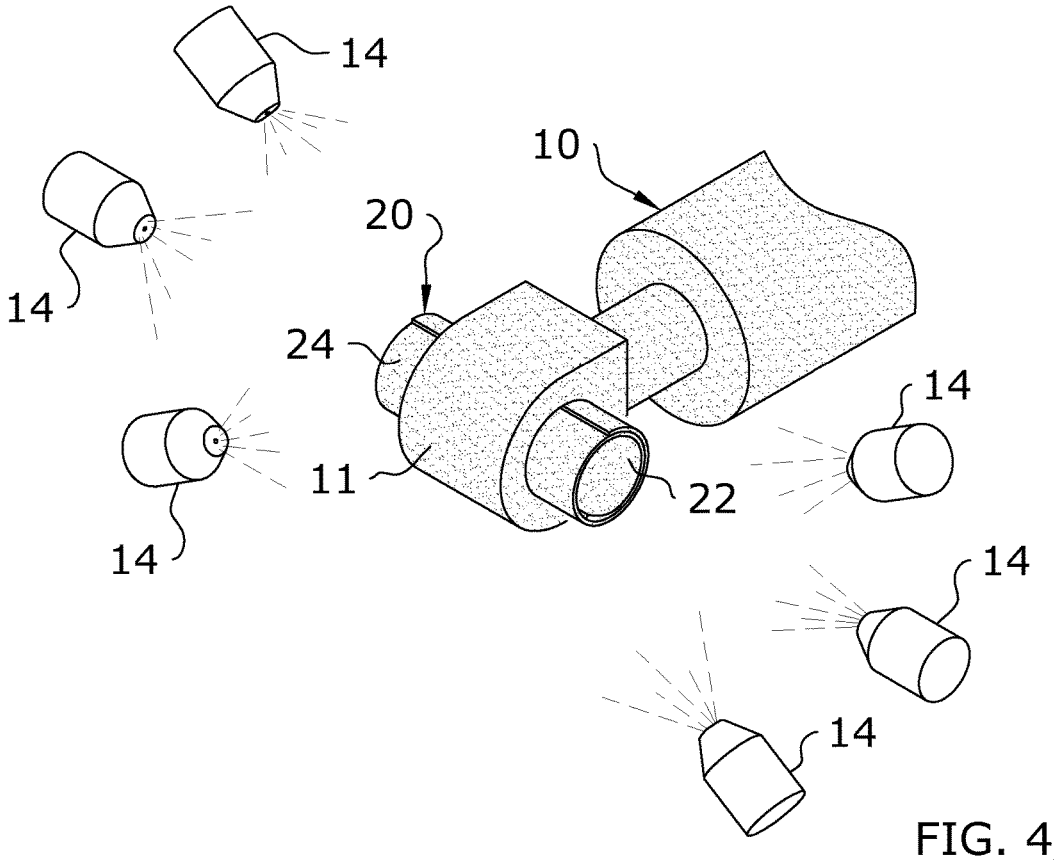
FIG. 4*j* is an upper perspective view of the object being painted and with the bore protected from the paint.

After the object 10 is cleaned, the object 10 is ready to be painted utilizing any desired painting process. FIG. 4*j* illustrates painting the object 10 utilizing a plurality of paint nozzles 14. The object 10 may also be dipped in paint for painting the object 10. The hydrophobic properties of the rolled hydrophobic sheet 20 prevent the paint from being absorbed by the rolled hydrophobic sheet 20 and also assist in repelling the paint from the interior surface of the bore 12. In addition, with the rolled hydrophobic sheet 20 extending outwardly at least one inch from both open ends of the bore 12, there is little risk of paint being applied to the interior surface of the bore 12.

After the object 10 is painted, the paint must be cured either by air drying or within a bake oven. The rolled hydrophobic sheet 20 may be removed prior to or after curing of the paint, whereas it is preferable to retain the rolled hydrophobic sheet 20 within the bore 12 during curing to prevent any accidental dripping of paint within the interior surface of the bore 12.

H. Removal of Rolled Hydrophobic Sheet

Figure 4K:
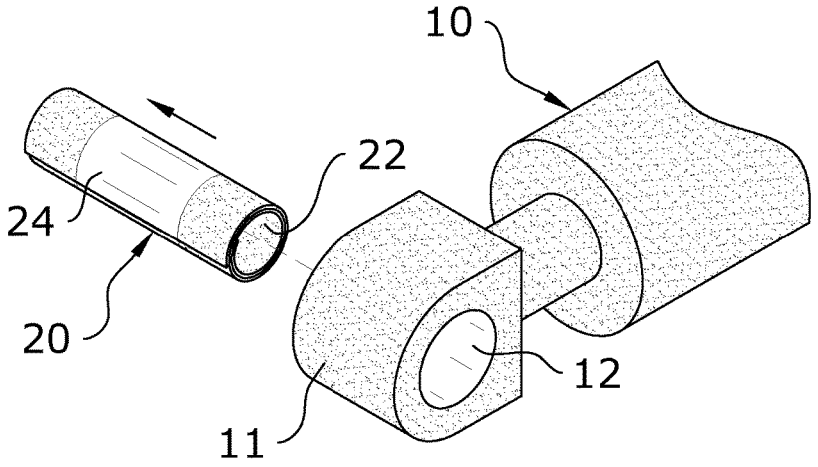
FIG. 4*k* is an upper perspective view of the tubular shield removed from the bore after painting to expose a clean interior surface of the bore.
Figure 5:
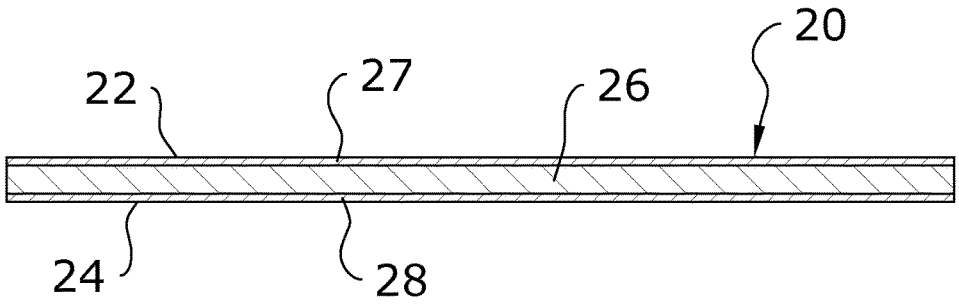
FIG. 5 is a cross sectional view taken along line 5-5 of FIG. 2.

The rolled hydrophobic sheet 20 may be removed by grasping one end and pulling outwardly from the bore 12 as shown in FIG. 4*k* of the drawings. However, it is preferable for the user to grasp both exposed ends of the hydrophobic sheet 20 with both hands, rotating the rolled hydrophobic sheet 20 and then pulling from one end to remove the same. As shown in FIG. 4*k*, the shading illustrates the paint adhering to the object 10 but not within the interior of the bore 12. The user is then able to insert a pin or other object 10 into the bore 12 without obstruction by paint or debris for assembly and to ensure that the bore 12 is clean of obstruction.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A method of forming a masking product for a bore in an object, comprising:

providing a hydrophobic sheet having an initial shape, a first surface and a second surface opposite of said first surface;

forming said hydrophobic sheet into a hydrophobic tubular shield, wherein said hydrophobic tubular shield has an exterior diameter less than an interior diameter of said bore when in an intermediate state;

retaining said hydrophobic tubular shield in said intermediate state prior to positioning within said bore;

inserting said hydrophobic tubular shield into said bore; and terminating said step of retaining said hydrophobic tubular shield to allow said hydrophobic tubular shield to expand from said intermediate state to a final state, wherein said final state of said hydrophobic tubular shield has a diameter greater than said intermediate state of said hydrophobic tubular shield and wherein an outer surface of said hydrophobic tubular shield is in contact with an interior surface of said bore;

cleaning said object with said hydrophobic tubular shield positioned within said bore of said object;

painting said object with said hydrophobic tubular shield positioned within said bore of said object, wherein the hydrophobic properties of said hydrophobic tubular shield prevent paint from being absorbed by said hydrophobic tubular shield and repel paint from said interior surface of said bore of said object.

2. The method of claim 1, wherein said initial shape of said hydrophobic sheet is planar.

3. The method of claim 1, wherein said initial shape is of said hydrophobic sheet is tubular.

4. The method of claim 1, wherein said hydrophobic tubular shield extends outwardly from a first opening of said bore at least one inch.

5. The method of claim 4, wherein said hydrophobic tubular shield extends outwardly from a second opening of said bore at least one inch, wherein said second opening of said bore is opposite of said first opening.

6. The method of claim 1, wherein said step of forming is comprised of rolling said hydrophobic sheet.

7. The method of claim 1, wherein said hydrophobic sheet is comprised of either a square or rectangular shape when in said initial shape.

8. The method of claim 1, wherein said hydrophobic sheet is comprised of a core material coated with a first hydrophobic layer to form said first surface.

9. The method of claim 8, wherein said hydrophobic sheet is comprised of a core material coated with a second hydrophobic layer to form said second surface.

10. The method of claim 9, wherein said core material is comprised of a non-hydrophobic material.

11. The method of claim 10, wherein said first hydrophobic layer and said second hydrophobic layer are comprised of rubber.

12. The method of claim 11, wherein said core material is comprised of compressed aramid fibers.

13. The method of claim 1, wherein said hydrophobic sheet is comprised of a plurality of fibers and a binder comprised of rubber.

14. The method of claim 13, wherein said rubber is comprised of a nitrile.

15. The method of claim 1, wherein said hydrophobic sheet is comprised of a fiber coated with a nitrile.

16. The method of claim 15, wherein said fiber is comprised of aramid fibers.

17. A method of forming a masking product for a bore in an object, comprising:

providing a hydrophobic sheet having an initial shape, a first surface and a second surface opposite of said first surface, and wherein said initial shape of said hydrophobic sheet is planar;

forming said hydrophobic sheet into a hydrophobic tubular shield having an intermediate state, wherein said hydrophobic tubular shield has an exterior diameter less than an interior diameter of said bore of said object when in said intermediate state;

retaining said hydrophobic tubular shield in said intermediate state prior to inserting said hydrophobic tubular shield within said bore of said object;

inserting said hydrophobic tubular shield into said bore of said object so that said hydrophobic tubular shield extends outwardly from opposing openings of said bore;

terminating said step of retaining said hydrophobic tubular shield to allow said hydrophobic tubular shield to expand from said intermediate state to a final state, wherein said final state of said hydrophobic tubular shield has a diameter greater than said intermediate state of said hydrophobic tubular shield and wherein an outer surface of said hydrophobic tubular shield is in contact with an interior surface of said bore of said object;

painting said object with said hydrophobic tubular shield positioned within said bore of said object, wherein the hydrophobic properties of said hydrophobic tubular shield prevent paint from being absorbed by said hydrophobic tubular shield and repel paint from said interior surface of said bore of said object; and removing said hydrophobic tubular shield after said step of painting said object.

18. The method of claim 17, wherein said step of forming is comprised of rolling said hydrophobic sheet.

19. A method of forming a masking product for a bore in an object, comprising:

providing an object having a bore, wherein said bore has a pair of opposing openings;

providing a hydrophobic sheet having an initial shape, a first surface and a second surface opposite of said first surface, wherein said initial shape of said hydrophobic sheet is planar, and wherein said hydrophobic sheet is comprised of either a square or rectangular shape when in said initial shape;

rolling said hydrophobic sheet upon itself into a tubular structure having opposing open ends forming a hydrophobic tubular shield having an intermediate state, wherein said hydrophobic tubular shield has an exterior diameter less than an interior diameter of said bore of said object when in said intermediate state;

retaining said hydrophobic tubular shield in said intermediate state prior to inserting said hydrophobic tubular shield within said bore of said object;

aligning a longitudinal axis of said hydrophobic tubular shield with an axis of said bore;

inserting said hydrophobic tubular shield into said bore of said object until said hydrophobic tubular shield extends outwardly from said pair of opposing openings of said bore;

terminating said step of retaining said hydrophobic tubular shield to allow said hydrophobic tubular shield to expand from said intermediate state to a final state, wherein said final state of said hydrophobic tubular shield has a diameter greater than said intermediate state of said hydrophobic tubular shield and wherein an outer surface of said hydrophobic tubular shield is in contact with an interior surface of said bore of said object;

cleaning said object with said hydrophobic tubular shield positioned within said bore of said object;

painting said object with said hydrophobic tubular shield positioned within said bore of said object, wherein the hydrophobic properties of said hydrophobic tubular shield prevent paint from being absorbed by said hydrophobic tubular shield and repel paint from said interior surface of said bore of said object; and removing said hydrophobic tubular shield after said step of painting said object.

* * * * *